US005360649A

United States Patent [19]

Sato et al.

[11] Patent Number: 5,360,649

[45] Date of Patent: Nov. 1, 1994

[54] THICKNESS-REDUCED DRAW-FORMED CAN

[75] Inventors: Nobuyuki Sato, Ebina; Ikuo Komatsu, Yokohama; Katsuhiro Imazu, Yokohama; Tomomi Kobayashi, Yokohama, all of Japan

[73] Assignee: Toyo Seikan Kaisha, Ltd., Tokyo, Japan

[21] Appl. No.: 974,521

[22] Filed: Nov. 12, 1992

[30] Foreign Application Priority Data

Nov. 12, 1991 [JP] Japan ..... 3-296076

[51] Int. Cl.[5] ..... B21C 37/00; B21C 23/24

[52] U.S. Cl. ..... 428/35.8; 428/34.7; 428/606; 72/46; 72/47

[58] Field of Search ..... 428/606, 607, 34.7, 428/35.3, 35.8; 148/12 C; 72/46, 47

[56] References Cited

U.S. PATENT DOCUMENTS

| | | | |
|---|---|---|---|
| 3,360,157 | 12/1967 | Bolt et al. | 220/64 |
| 4,001,052 | 1/1977 | Nakazato et al. | 148/36 |
| 4,058,414 | 11/1977 | Matsuoka | 148/12 F |
| 4,465,525 | 8/1984 | Yoshimura et al. | 148/37 |
| 4,734,303 | 3/1988 | Fujiwara et al. | 428/606 |
| 4,956,242 | 9/1990 | Shimizu et al. | 428/606 |
| 4,962,659 | 10/1990 | Imazu et al. | 72/349 |
| 4,984,708 | 1/1991 | Imazu et al. | 220/660 |

*Primary Examiner*—George F. Lesmes
*Assistant Examiner*—Blaine Copenheaver
*Attorney, Agent, or Firm*—Sughrue, Mion, Zinn, Macpeak & Seas

[57] ABSTRACT

A thickness-reduced deep-draw-formed can obtained by using, as the substrate, a cold-rolled steel plate having a carbon content in the steel of 0.02 to 0.15% by weight, a manganese content in the steel of 0.2 to 1.0% by weight, a mean diameter of crystal grain of smaller than 6.0 μm, a tensile strength over a range of from 35 to 55 kg/mm$^2$, and a thickness of 0.17 to 0.30 mm in a step of subjecting an organic resin-coated structure of the surface-treated steel plate to the thickness-reducing deep-draw forming. This makes it possible to suppress the generation and accumulation of heat in the organic resin-coated steel plate to a level lower than the conventional levels. Therefore, the organic resin coating is prevented from being peeled off or damaged and, as a result, the corrosion resistance can be markedly improved. Moreover, wrinkles can be effectively prevented from developing at the time of reducing the thickness, and the forming can be continuously carried out at a high speed without being substantially affected by the generation or accumulation of heat. It is further possible to easily carry out the post treatments such as necking, flanging and multi-beading after the forming. The thickness-reduced deep-draw-formed can of the invention is effective particularly for preserving various kinds of juices, coffee, oolong tea and any other beverages after it is hermetically sealed, retort-sterilized and reduced for its internal pressure.

12 Claims, 4 Drawing Sheets

THICKNESS-REDUCED DRAW-FORMED CAN

BACKGROUND OF THE INVENTION (1) Field of the Invention

The present invention relates to a thickness-reduced deep-draw-formed can prepared from a resin-coated surface-treated steel plate. More particularly, the invention relates to a thickness-reduced deep-draw-formed can that exhibits excellent adhesiveness to an organic resin coating and excellent corrosion resistance, and has improved formability and form workability.

(2) Description of the Related Art

A process for producing a side-seamless can has heretofore been known comprising forming a metal blank such as an aluminum plate, a tin plate or a tin-free steel plate into a cup having a barrel with no seam on the side surface and a bottom integrally connected to the barrel without seam by subjecting the metal blank to at least one stage of drawing between a drawing die and a punch, and as required ironing the barrel of the cup between an ironing punch and an ironing die to reduce the thickness of the barrel. In preparing the side-seamless cans, it has also been known to use the metal blank on which is laminated a film of a thermoplastic resin such as polypropylene or a thermoplastic polyester.

In Japanese Unexamined Patent Publication No. 1-258822, the present inventors have proposed a process for reducing the thickness of the side wall of a can by bending and elongation at the time of deep-draw-forming the can. That is, the present inventors have proposed a redrawing process comprising holding a preliminarily drawn cup of a coated metal plate by an annular holding member inserted in the cup and a redrawing die, and relatively moving in mesh with each other the redrawing die and a redrawing punch that is provided coaxially with the holding member and the redrawing die in a manner to go into and come out from the holding member, in order to deep-draw-form a cup having a diameter smaller than that of the preliminarily drawn cup, wherein the radius of curvature ($R_D$) of the working corner portion of the redrawing die is set to be 1 to 2.9 times as great as the blank thickness ($t_B$) of the metal plate, the radius of curvature ($R_H$) of the holding corner portion of the holding member is set to be 4.1 to 12 times as great as the blank thickness ($t_B$) of the metal plate, flat portions of the holding member and the redrawing die engaging with the preliminarily drawn cup have a dynamic coefficient of friction of from 0.001 to 0.2, the draw-forming of at least one stage is carried out so that the redraw ratio defined by the ratio of the diameter of the shallow-draw-formed cup to the diameter of the deep-draw-formed cup lies in the range of from 1.1 to 1.5, and the side wall of the cup is uniformly bent to reduce the thickness along the entire direction of height thereof. As the coated metal plate, furthermore, it has been proposed to use a tin-free steel plate (electrolytically chromate-treated steel plate) coated with an epoxy-type paint.

SUMMARY OF THE INVENTION

In the draw-redraw forming, plastic flow takes place so that the size of the coated metal plate increases in the direction of height of the can and contracts in the circumferential direction of the can barrel. Accordingly, the thickness tends to increase from the lower portion toward the upper portion on the side wall of the can barrel that is obtained by the draw-redraw forming. The above-mentioned conventional method of reducing the thickness based on bending and elongation gives advantages in that the side wall portion is elongated and its thickness is reduced as a whole and that the thickness distribution is uniformalized in the up-and-down direction often accompanied, however, by such defects as peeling of the organic resin coating off the coated steel plate and cracks that develop in the coating.

When a steel plate coated with an organic resin is subjected to the reduction of thickness and to the deep-draw-forming, in general, the heat is generated due to the plastic deformation of the steel material. The heat that is generated increases the temperature not only of the steel material but also of the organic resin coating, and further increases the temperature of the forming tools due to the conduction of heat. In the practical production of cans on a commercial scale, the forming is usually carried out by a press which revolves at a speed of greater than 70 revolutions a minute. In this case, therefore, the heat energy generated by the plastic deformation of the steel material raises the temperature of the steel material and the organic resin coating rather than raising the temperature of the forming tools since the time in which the can is brought into contact with the tool is short.

As the temperature rises, the organic resin coating is melted at around its melting point when it is composed of a thermoplastic resin or is remarkably softened at a temperature higher than a glass transition point when it is composed of a thermosetting resin. During the step of reducing the thickness and deep-draw-forming, therefore, the working is hampered by the following problems as the organic resin coating is heated at such temperature ranges.

A) The organic resin coating peels off and is damaged as it comes in contact with the tools.

B) The organic resin coating that is melted or softened prevents the blank holding force that is necessary for the redraw working from being transmitted to the steel material. Therefore, wrinkles develop on the steel material and the thickness is not reduced as expected.

When the working is hampered by such troubles, the metal is exposed over increased areas on the inner surface of the can and the function of the container is seriously deteriorated. Moreover, adverse effects are given to the necking, flanging and multi-beading that are carried out after the step of reducing the thickness and deep-draw-forming.

It is an object of the present invention to provide a thickness-reduced deep-draw-formed can in which in reducing the thickness and deep-draw-forming the organic resin-coated steel plate, the heat is generated by the organic resin-coated steel plate and is stored to a degree which is smaller than that of the conventional counterparts, and the organic resin coating is prevented from being peeled off or damaged and, as a result, the corrosion resistance is drastically improved.

Another object of the present invention is to provide a thickness-reduced deep-draw-formed can in which during the step of reducing the thickness and deep-draw-forming, the wrinkles are effectively prevented from developing, the cans can be continuously formed at a high speed without being virtually affected by the generation of heat or accumulation of heat, and further the post-treatment such as necking, flanging, and multi-beading can be easily carried out after the step of forming.

According to the present invention, there is provided a thickness-reduced deep-draw-formed can which is obtained by reducing the thickness of and deep-draw-forming an organic resin-coated structure of a surface-treated steel plate comprising, as the substrate, a cold-rolled steel plate having a carbon content in the steel of 0.02 to 0.15% by weight, a manganese content in the steel of 0.2 to 1.0% by weight, a mean diameter of crystal grain of smaller than 6.0 μm, a tensile strength of over a range of from 35 to 55 kg/mm$^2$, and a thickness of 0.17 to 0.30 mm.

In the present invention, when the organic resin of the organic resin-coated structure is a thermoplastic resin, the cold-rolled steel plate and the thermoplastic resin should be so combined together as to satisfy the following formula (1), $$S \times t^{1.17} < 0.056 \times (Tm - 45) \quad (1)$$

wherein S is the tensile strength (kg/mm$^2$) of the cold-rolled steel plate, t is the thickness (mm) of the cold-rolled steel plate, and Tm is the melting point (°C.) of the thermoplastic resin.

When the organic resin of the organic resin-coated structure is a thermosetting resin, on the other hand, the cold-rolled steel plate and the thermosetting resin should be so combined together as to satisfy the following formula (2), $$S \times t^{1.17} < 0.056 \times (Tg + 75) \quad (2)$$

wherein S is the tensile strength (kg/mm$^2$) of the cold-rolled steel plate, t is the thickness (mm) of the cold-rolled steel plate, and Tg is the glass transition point (°C.) of the thermosetting resin.

BRIEF DESCRIPTION OF THE DRAWINGS

The accompanying drawing which are incorporated in and constitute a part of this specification, illustrate one embodiment of the invention and, together with the description, serve to explain the principles of the invention, in which.

DETAILED DESCRIPTION OF THE PREFERRED EMBODIMENT

Figure 1:
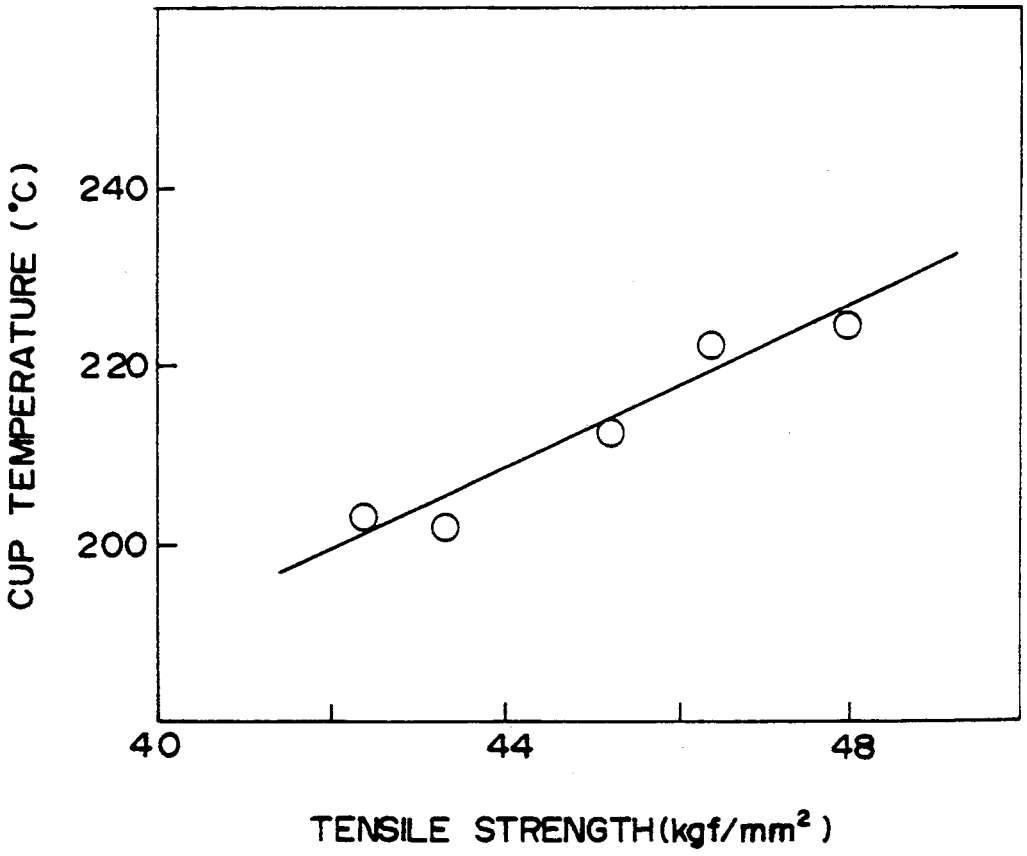
FIG. 1 is a graph showing a relationship between the tensile strength and the cup temperature using organic resin-coated structures of cold-rolled steels having various tensile strengths.

The thickness-reduced deep-draw-formed can of the present invention has a first feature in the use of an organic resin-coated structure of a surface-treated steel plate comprising, as the substrate, a cold-rolled steel plate having a carbon content in the steel of from 0.02 to 0.15% by weight and particularly from 0.04 to 0.12% by weight, a manganese content in the steel of from 0.2 to 1.0% by weight and particularly from 0.4 to 0.8% by weight, a mean diameter of crystal grain of smaller than 6.0 μm and particularly from 4.0 to 6.0 μm, a tensile strength of from 35 to 55 kg/mm$^2$ and particularly from 37 to 48 kg/mm$^2$, and a thickness of from 0.17 to 0.30 mm and particularly from 0.18 to 0.30 mm. The above cold-rolled steel plate that is used as the substrate makes it possible to smoothly carry out the reduction of thickness and the deep-draw-forming, and to suppress the generation and accumulation of heat to a small level during the step of forming the organic resin-coated structure.

The step of reducing the thickness of and deep-draw-forming the organic resin-coated steel plate is accompanied by the generation of heat due to plastic deformation of the steel material as mentioned already. The heat is generated even by the uncoated steel plate, as a matter of course. However, the uncoated steel plate has a surface which serves as a good heat conductor and does not bring about problem such as accumulation of heat. In the case of the organic resin-coated steep plate, however, there exists the organic resin coating which is a poor heat conductor between the steel plate and the tools, arousing a problem with respect to accumulation of the heat.

It is important that the cold-rolled steel plate substrate which is subjected to the reduction of thickness and deep-draw-forming must fundamentally have formability or workability capable of withstanding the reduction of thickness that is based on the draw-redraw forming or bending-bending back deformation. At the same time, what is further important for eliminating the aforementioned problems (A) and (B) is that the cold-rolled steel plate should generate and accumulate the heat to a small degree during the step of working.

In the present invention, the carbon content and manganese content in the cold-rolled steel plate as well as the mean diameter of crystal grain are specified to lie within predetermined ranges mentioned above. This is because the cold-rolled steel plate having the above-mentioned ranges permits the thickness to be easily reduced relying upon the draw-redraw forming or the bending-bending back deformation.

That is, when the carbon content is greater than the above-mentioned range, the workability decreases and it becomes difficult to effect the redrawing or to reduce the thickness by bending at the time of redrawing. When the manganese content is greater than the above-mentioned range, the steel plate becomes so brittle that it no longer can withstand the working performed by the present invention. Moreover, when both the carbon content and the manganese content are lower than the above-mentioned ranges, the finally obtained thickness-reduced deep-draw-formed can is not satisfactory in regard to its strength.

When the mean diameter of crystal grain is greater than the above-mentioned range, the cold-rolled steel plate is longitudinally elongated by the drawing-redrawing deformation or by the deformation in the monoaxial direction (axial direction of the can) based on the elongation by bending. Therefore, the surface of the steel plate is coarsened, and the can that is finally obtained exhibits poor appearance, defective adhesion to the coating and exposure of metal. According to the present invention which uses the cold-rolled high-carbon steel plate having a mean diameter of crystal grain of smaller than 6.0 μm, the above defects are eliminated and the thickness-reduced deep-draw-formed can is obtained exhibiting markedly improved appearance and corrosion resistance.

The present inventors have found the importance of selecting a cold-rolled steel plate having a tensile strength that lies in the above-mentioned range and having a thickness that lies within the range of from 0.17 to 0.30 mm from the standpoint of suppressing the generation and accumulation of heat to a low level in the step of deep-draw-forming.

In the accompanying FIG. 1, there is plotted the relationship between the tensile strength and the cup temperature in the final step of drawing using organic resin-coated structures (which will be described later in detail) employing cold-rolled steel plates that have various tensile strengths. It will be understood from FIG. 1 that there exists a predetermined relationship between the tensile strength of the cold-rolled steel plate and the cup temperature indicating a tendency in that the cup temperature increases with an increase in the tensile strength, i.e., increases with an increase in the degree of generating and accumulating the heat of the coated structure.

In the present invention, when the tensile strength of the cold-rolled steel plate becomes greater than 55 $kg/mm^2$, the coating tends to be peeled off or tends to be damaged by the tools irrespective of the selection of the resin coating or the working conditions and besides, the blank holding force is not sufficiently transmitted and wrinkles develop. When the tensile strength becomes smaller than 35 $kg/mm^2$, on the other hand, the steel plate is locally elongated at the time when its thickness is reduced by bending and elongation, and it becomes difficult to obtain a thickness-reduced deep-draw-formed can having a uniform thickness and good form.

According to the present invention, what is further important is that the cold-rolled steel plate must have a thickness that lies within the aforementioned range to suppress the generation and accumulation of heat. That is, there exists a relationship expressed by the following equation (3) among the thickness t, mass M, surface area s and density ρ of the cold-rolled steel plate, i.e., $$t = M/(\rho \cdot s) \quad (3)$$

Therefore, reducing the thickness t corresponds to reducing the mass M of the steel plate and increasing the surface area s, contributing to effecting two favorable actions, i.e., reduction in the amount of the generated heat (varies in proportion to the mass) during the working and increase in the amount of the heat (varies in proportion to the surface area) radiated from the surface.

When the thickness exceeds 0.30 mm, the coating tends to be peeled off or tends to be damaged by the tools irrespective of the selection of the resin coating or the change in the working conditions. Moreover, the blank holding force is not sufficiently transmitted and wrinkles generate. When the thickness becomes smaller than 0.17 mm, on the other hand, the finally obtained thickness-reduced deep-draw-formed can loses its strength, and the can tends to become easily deformed by a difference between the internal pressure and the external pressure during or after the retort-sterilization.

When the organic resin coating is composed of a thermoplastic resin in the present invention, it was that the melting point of the thermoplastic resin and the thickness t and tensile strength S of the cold-rolled steel plate should be so combined together as to satisfy the aforementioned formula (1) from the standpoint of suppressing the generation and accumulation of the heat during the working.

Figure 2:
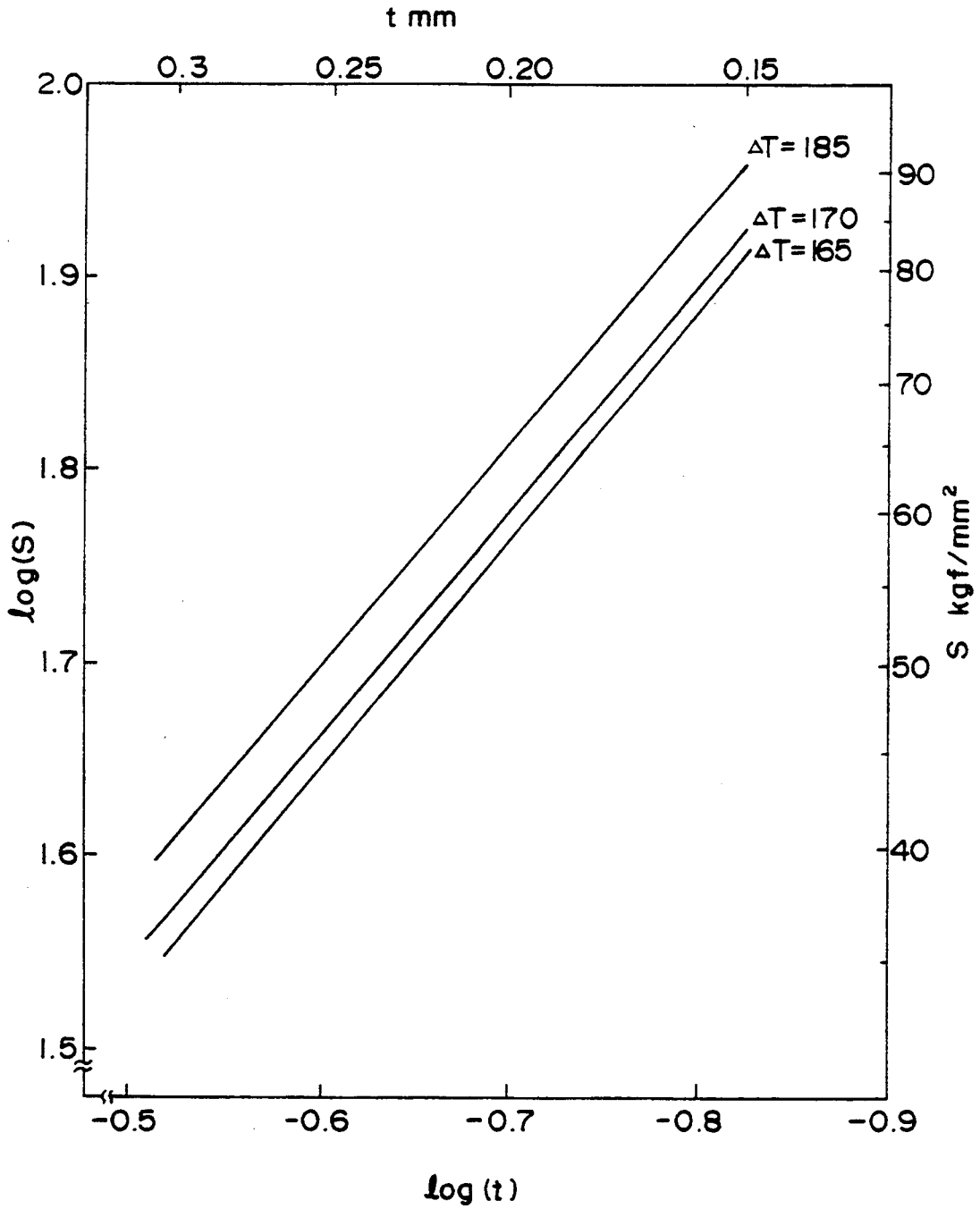
FIG. 2 is a graph plotting the temperature increments (ΔT) of the cup starting with room temperature, wherein the abscissa represents in logarithm the thickness t of the cold-rolled steel plate and the ordinate represents in logarithm the tensile strength of the cold-rolled steel plate.

In the accompanying FIG. 2, there is plotted the temperature increments (ΔT) of the cup made of the organic resin-coated steel plate starting with room temperature (25° C.) in which the abscissa represents logarithm the thickness t of the cold-rolled steel plate and the ordinate represents in logarithm the tensile strength S of the cold-rolled steel plate. The results of FIG. 2 indicate that when the thickness t and the tensile strength S are changed, the temperature increment (ΔT) of the cup remains constant provided a value $S \times t^{1.17}$ remains constant, ΔT increases with an increase in the value $S \times t^{1.17}$, and ΔT decreases with a decrease in the above value. The value on the right side of the aforementioned empirical formula (1) corresponds to a temperature which is lower than the melting point of the resin by 20° C. According to the present invention, therefore, the aforementioned problems (A) and (B) are eliminated if the organic resin coating is maintained at a temperature which is lower than its melting point by at least 20° C.

When the organic resin coating is composed of a thermosetting resin, the aforementioned problems (A) and (B) can be eliminated by so selecting the cold-rolled steel plate and the thermosetting resin as to satisfy the empirical formula (2). The left side of the formula (2) is the same as the left side of the formula (1), but the right side of the formula (2) corresponds to a temperature which is higher than the softening point Tg of the thermosetting resin by 100° C. In the case of the thermosetting resin, therefore, trouble is prevented from developing in the coating during the working provided the temperature is maintained to be lower than the softening point by 100° C.

Figure 3:
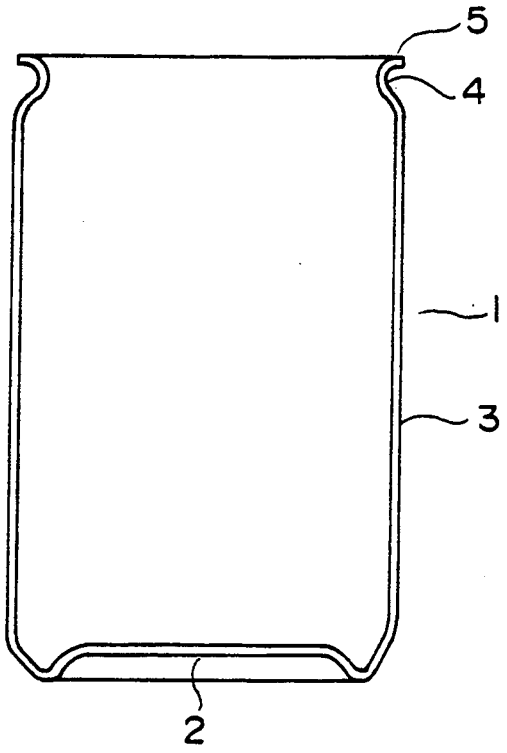
FIG. 3 is a diagram illustrating a deep-draw-formed can according to the present invention.

In FIG. 3 which shows a thickness-reduced deep-draw-formed can of the present invention, the deep-draw-formed can 1 is formed by deep-draw-forming (draw-redrawing) an organic resin-coated surface-treated steel plate, and comprises a bottom 2 and a side wall 3. As required, a flange 5 is formed at the upper end of the side wall 3 via a neck 4. In this can 1, in general, the side wall 3 has a thickness which is reduced by bending and elongation compared to the bottom 2.

Figure 4:
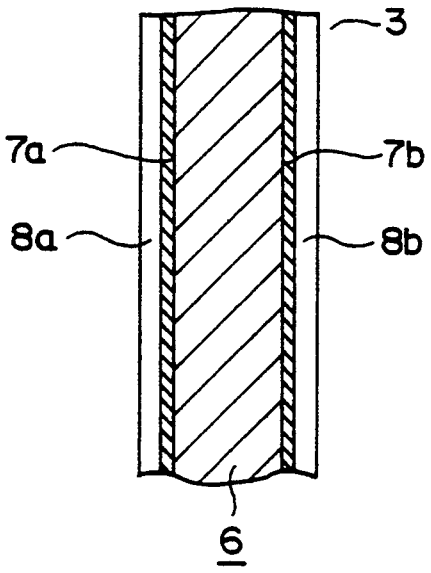
FIG. 4 is a sectional view showing a coated metal plate that is favorably used in the present invention.

Referring to FIG. 4 which illustrates the cross-sectional structure of the side wall 3, the side wall 3 is constituted by a cold-rolled steel plate base 6, surface treatment layers *7a*, *7b* that exist on the surfaces thereof, and organic resin coatings 8*a*(8*b*) that are intimately adhered via the surface treatment layers *7a*(*7b*). The cross-sectional structure of the bottom 2 is the same as the cross-sectional structure of the side wall except that the thickness as a whole is slightly greater than that of the barrel and that the metal and the resin are not monoaxially oriented unlike those on the side wall 3.

The cold-rolled steel plate substrate 6 used in the present invention may be produced by any production method without any particular limitation provided it has the aforementioned analytical values and properties. In general, the cole-rolled steel plate substrate is obtained by effecting the cold-rolling of one stage at a rolling reduction ratio of 70 o 90%, effecting the annealing and, as required, effecting the refining-rolling to adjust the strength. The annealing should be effected at a temperature of 650° to 700° C. for 30 to 60 seconds. The cold-rolled steel plate substrate is available as a steel for top and bottom wrap-seam closures for three-piece cans.

The surface treatment layer 7 is formed by effecting one or two or more kinds of surface treatments such as zinc plating, tin plating, nickel plating, electrolytic chromate treatment and chromate treatment. A preferred example of the surface-treated steel plate is an electrolytically chromate-treated steel plate, especially one comprising 10 to 200 $mg/m^2$ of a metallic chromium layer and 1 to 50 $mg/m^2$ (as calculated as the metallic chromium) of a chromium oxide layer. This surface treatment layer is excellent in the combination of the adhesion of the coating and the corrosion resistance. Another preferred example is a hard tin plate having a deposited tin amount of 0.5 to 11.2 $g/m^2$, and it is preferred that the tin plate be subjected to a chromate treatment or a chromate/phosphate treatment so that the deposited chromium amount is 1 to 30 $mg/m^2$ as calculated as metallic chromium. Still another example of the surface-treated steel plate is an aluminum-covered steel plate formed by deposition of aluminium or cladding of aluminum.

As the organic resin coating 8, there can be mentioned various thermoplastic resin films and thermosetting and thermoplastic resin coatings. As the film, there can be mentioned films of olefin resins such as polyethylene, polypropylene, an ethylene/propylene copolymer, an ethylene/vinyl acetate copolymer, an ethylene/acrylic ester copolymer and an ionomer, films of polyester such as polyethylene terephthalate, polybutylene terephthalate, an ethylene terephthalate/isophthalate copolymer, an ethylene terephthalate/asipate copolymer, an ethylene terephthalate/sebacate copolymer and a butylene terephthalate/isophthalate copolymer, films of polyamides such as nylon 6, nylon 6,6, nylon 11 and nylon 12, and films of polyvinyl chloride and polyvinylidene chloride. There films can be undrawn films or biaxially drawn films. It is preferred that the film thickness be 3 to 50 μm, especially 5 to 40 μm.

Lamination of the film onto the metal plate is carried out by heat fusion bonding, dry lamination or extrusion coating. In the case where the adhesiveness (heat fusion bondability) is poor between the film and metal plate, an urethane adhesive, an epoxy adhesive, an acid-modified olefin resin adhesive, a copolyamide adhesive, a copolyester adhesive or an adhesive primer described below is interposed between them. A paint having an excellent adhesion to the metal plate, a high corrosion resistance and an excellent adhesion to the resin film is used as the adhesive primer. As the adhesive primer, there can be used a paint comprising an epoxy resin and a curing agent resin for the epoxy resin, such as a phenolic resin, an amino resin, an acrylic resin or a vinyl resin, especially an epoxy-phenolic resin, and an organosol paint comprising a vinyl chloride copolymer resin and an epoxy resin. The thickness of the adhesive primer or adhesive layer is preferably 0.1 to 5 μm.

At the lamination, a layer of the adhesive primer or adhesive is formed on one or both of the metal plate and the resin film, and after drying or partial curing is conducted according to need, both are heated, pressbonded and integrated. It sometimes happens that the biaxial molecular orientation in the film is somewhat moderated during the laminating operation, but this moderation has no influence on draw-redraw forming, and sometimes the forming workability is preferably improved by this moderation.

An inorganic filler (pigment) can be incorporated into the outer surface film used in the present invention so as to conceal the metal plate and assist the transmission of the blank holding force to the metal plate at the draw-redraw forming. As the inorganic filler, there can be used inorganic white pigments such as rutile titanium dioxide, anatase titanium dioxide, zinc flower and gloss white, white extender pigments such as baryta, precipitated baryta sulfate, calcium carbonate, gypsum, precipitated silica, aerosil, talc, calcined or uncalcined clay, barium carbonate, alumina white, synthetic or natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Optional protecting paints composed of thermosetting or thermoplastic resins can be used instead of the film or together with the film. For example, there can be mentioned modified epoxy paints such as a phenol-epoxy paint and an amino-epoxy paint, vinyl or modified vinyl paints such as a vinyl chloride/vinyl acetate copolymer, a partly saponified product of vinyl chloride/vinyl acetate copolymer, a vinyl chloride/vinyl acetate/maleic anhydride copolymer, an epoxy-modified vinyl paint, an epoxyamide-modified vinyl paint and an epoxyphenol-modified vinyl paint, acrylic resin paints, and synthetic rubber paints such as a styrene/-butadiene copolymer. There paints can be used singly or in the form of mixture of two or more of them.

These paints can be used in the form of an organic solvent solution such as an enamel or lacquer or in the form of an aqueous dispersion or aqueous solution and applied to the metal blank by roller coating, spray coating, dip coating, electrostatic coating or electrophoretic coating. Of course, when the resin paint is thermosetting, the paint is baked according to need. In view of the corrosion resistance and workability, it is preferred that the thickness (dry state) of the protecting coating be 2 to 30 μm, especially 3 to 20 μm. A lubricant can be incorporated in the coating so as to improve the draw-redrawing operation.

Figure 5:
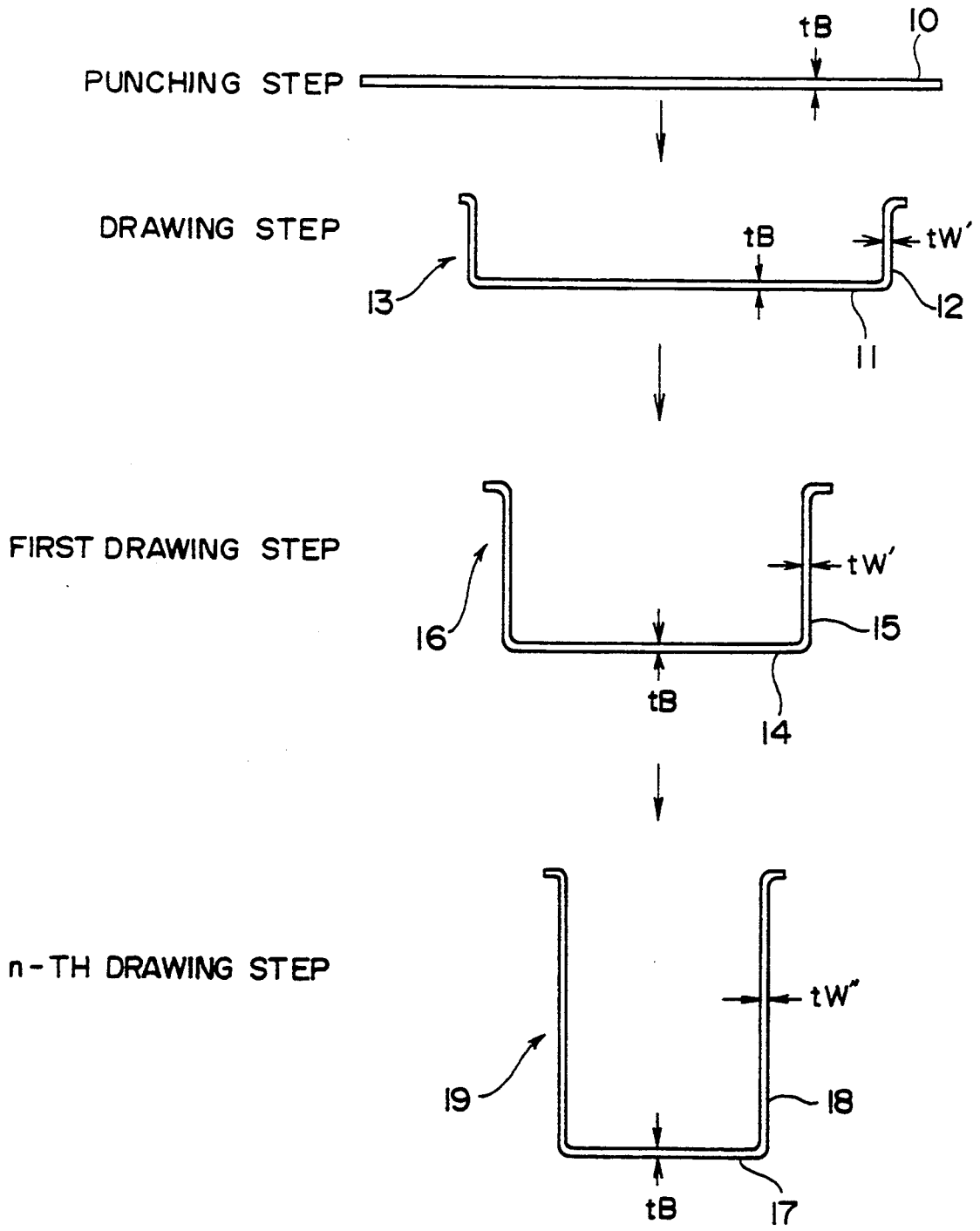
FIG. 5 is a sectional view illustrating the forming steps according to the present invention.

Referring to FIG. 5 showing the draw-redrawing operation, a coated metal plate 10 is punched into a disk, and at a preliminary drawing step, the disk is formed into a preliminarily drawn cup 13 comprising a bottom 11 and a side wall 12 by using a preliminarily drawing punch and die having a large diameter. This preliminarily drawn cup is held by an annular holding member (not shown) inserted into the cup and a redrawing die (not shown), and the redrawing die and a redrawing punch arranged coaxially with the holding member and redrawing die are relatively moved so that the redrawing punch and redrawing die are meshed with each other, whereby a deep-draw-formed cup 16 having a diameter smaller than that of the preliminarily drawn cup is prepared by the draw forming. Similarly, the cup 16 is draw-formed into a cup 19 having a smaller diameter.

Reference numerals 14 and 17 represent bottoms of the cups 16 and 19, respectively, and reference numerals 15 and 18 represent side walls of the cups 16 and 19, respectively. At this redraw forming, it is preferred that the thickness of the coated metal plate be reduced by bending and elongation at the working corner of the redrawing die, and at this redraw forming, it also is preferred that the thickness be reduced by applying light ironing to the coated metal plate between the redrawing punch and redrawing die.

Referring to FIG. 5 generally, the following thickness relation is established among side walls of the respective cups:

$$tw''' \leqq tw'' \leqq tw' \leqq tB \quad (1)$$

It is preferred that the draw ratio defined by the following formula:

$$\text{Draw ratio} = \frac{\text{blank diameter}}{\text{punch diameter}} \quad (2)$$

be from 1.2 to 2.0, especially from 1.3 to 1.9, and that the redraw ratio defined by the following formula:

$$\text{Redraw ratio} = \frac{\text{diameter of drawing punch}}{\text{diameter of redrawing punch}} \quad (3)$$

be from 1.1 to 1.6, especially from 1.15 to 1.5. It also is preferred that the degree of reduction of the thickness of the side wall be 5 to 45%, especially about 5 to about 40%, of the blank thickness (bottom thickness). Preferably, such conditions that cause molecular orientation in the resin layer be adopted for the draw-redraw forming. For this purpose, the draw-redraw forming is preferably carried out at the drawing temperature of the resin layer, for example, at 40° to 200° C. in the case of PET.

The draw forming or redraw forming can be carried out by applying a lubricant such as liquid paraffin, synthetic paraffin, edible oil, hydrogenated edible oil, palm oil, a natural wax or a polyethylene wax onto the coated metal plate or the cup. The coated amount of the lubricant changes according to the kind of the lubricant, but it is generally preferred that the lubricant be coated in an amount of 0.1 to 10 mg/dm$^2$, especially 0.2 to 5 mg/dm$^2$. Coating of the lubricant is accomplished by spraying the lubricant in a melted state on the surface of the plate or the cup.

The obtained deep-draw-formed cup is directly subjected to post treatments such as washing with water and drying and is then subjected to doming, trimming, necking, beading and flanging to obtain a final can barrel.

According to the present invention, use is made, as the substrate, of a cold-rolled steel plate having a carbon content in the steel of 0.02 to 0.15% by weight, a manganese content in the steel of 0.2 to 1.0% by weight, a mean diameter of crystal grain of smaller than 6.0 μm, a tensile strength of 35 to 55 kg/mm$^2$ and a thickness of 0.17 to 0.30 mm in a step of subjecting an organic resin-coated structure of the surface-treated steel plate to the thickness-reducing deep-draw forming. This makes it possible to suppress the generation and accumulation of heat in the organic resin-coated steel plate to a level lower than the conventional levels. Therefore, the organic resin coating is prevented from being peeled off or damaged and, as a result, the corrosion resistance can be markedly improved.

Moreover, the resin coating maintains its own hardness which helps effectively transmit the blank holding force. Therefore, wrinkles can be effectively prevented from developing at the time of forming, and the forming can be carried out at a high speed without being substantially affected by the generation or accumulation of heat. It is further made possible to easily carry out the post treatments such as necking, flanging and multi-beading after the forming.

The thickness-reduced deep-draw-formed can of the present invention is effective particularly for preserving various kinds of juices, coffee, oolong tea and any other beverages after it is hermetically sealed, retort-sterilized and reduced for its internal pressure.

EXAMPLES

The melting point (Tm) of the thermoplastic resin and the glass transition point (Tg) of the thermosetting resin defined by the present invention are measured as described below.

Measurement of Tm

A chart of temperature vs. quantity of heat is plotted based on the scanning-type differential thermal analytical method (DSC) while raising the temperature at a rate of 10° C. a minute, and a peak temperature on a heat absorption curve that stems from the melting of thermoplastic resin is denoted by Tm.

Measurement of Tg

A chart of temperature vs. quantity of heat is plotted based on the scanning-type differential thermal analytical method (DSC) while raising the temperature at a rate of 10° C. a minute, and a peak temperature on a heat absorption curve that stems from the softening of thermosetting resin coating after cured by baking is denoted by Tg.

Example 1

A surface-treated steel plate was prepared by forming 150 mg/m$^2$ of a metallic chromium layer and 20 mg/m$^2$ of a chromium oxide layer as the surface treatment layer on a cold-rolled steel plate having a carbon content (C) in the steel of 0.10% by weight, a manganese content (Mn) in the steel of 0.50% by weight, a mean diameter of crystal grain of 5.4 μm, a tensile strength of 43 kg/mm$^2$, and a blank thickness of 0.26 mm.

A polyethylene terephthalate/isophthalate copolymer film having a thickness of 20 μm and a melting point (Tm) of 230° C. was heat-bonded to both surfaces of the surface-treated steel plate to obtain a resin-coated steel plate. Palm oil was applied on the resin-coated steel plate, and the steel plate was punched into a disk having a diameter of 179 mm and the disk was formed into a shallow-draw-formed can according to customary procedures. The draw ratio at this drawing step was 1.56.

In the subsequent first and second redrawing steps, the draw-formed cup was preliminarily heated at 80° C., and redraw forming was continuously carried out at 100 strokes a minute. The following conditions were adopted in the first and the second redrawing steps.

First redraw ratio: 1.37

Second redraw ratio: 1.27

Radius of curvature (Rd) of working corner of redrawing die: 0.60

The properties of the deep-draw-formed cup obtained by the above redraw forming were as follows.

Cup diameter: 63 mm

Cup height: 127 mm

Average thickness change ratio of side wall: −20%

Then, the bottom was formed according to customary procedures, palm oil was removed by water washing, and trimming was carried out. Then, the cup was subjected to necking and flanging to obtain a thickness-reduced deep-draw-formed can.

Table 1 shows the results of evaluation of the formability and corrosion resistance. As a result, there was obtained a thickness-reduced deep-draw-formed can having excellent formability, especially excellent adhesiveness to the resin coating and excellent corrosion resistance.

Example 2

A thickness-reduced deep-draw-formed can was prepared in the same manner as described in Example 1 with the exception of using a cold-rolled steel plate having a carbon content (C) in the steel of 0.10% by weight, a manganese content (Mn) in the steel of 0.50% by weight, a mean diameter of crystal grain of 5.4 μm, a tensile strength of 48 kg/mm$^2$, and a blank thickness of 0.20 mm.

As a result, there was obtained a thickness-reduced deep-draw-formed can having excellent formability, pressure resistance and corrosion resistance as shown in Table 1.

Example 3

A thickness-reduced deep-draw-formed can was prepared in the same manner as described in Example 1 with the exception of using a cold-rolled steel plate having a carbon content (C) in the steel of 0.07% by weight, a manganese content (Mn) in the steel of 0.50% by weight, a mean diameter of crystal grain of 5.2 μm, a tensile strength of 38 kg/mm$^2$, and a blank thickness of 0.28 Am, and as average thickness change ratio of side wall of −30%. There was obtained an excellent container without any abnormal condition in the formability, pressure resistance and corrosion resistance as shown in Table 1.

Example 4

A thickness-reduced deep-draw-formed can was prepared in the same manner as described in Example 1 with the exception of coating both surfaces of the steel plate with a thermosetting acrylic acid-modified epoxyphenol resin paint as an organic resin coating maintaining a thickness of 10 μm. The properties and the results of evaluation were as shown in Table 1. There was obtained a container having good formability, pressure resistance and corrosion resistance.

Comparative Example 1

A thickness-reduced deep-draw-formed can was prepared in the same manner as described in Example 1 with the exception of using a cold-rolled steel plate having a carbon content (C) in the steel of 0.12% by weight, a manganese content (Mn) in the steel of 0.80% by weight, a mean diameter of crystal grain of 4.4 μm, and a tensile strength 58 kg/mm$^2$. The formability and the results of evaluation were as shown in Table 1. During the step of forming, the surfaces of the cold-rolled steel plate and the surfaces of the resin coating were coarsened conspicuously, and the surface of the resin coating was melted as the upper portion of the formed can. In the test of corrosion resistance, the can subjected to the necking exhibited poor corrosion resistance. Moreover, leakage developed in many cans. Therefore, the cans could not be used as containers.

Comparative Example 2

A thickness-reduced deep-draw-formed can was prepared in the same manner as described in Example 1 with the exception of using the steel plate having a carbon content (C) in the steel of 0.16% by weight, a manganese content (Mn) in the steel of 0.80% by weight, a mean diameter of crystal grain of 3.8 μm, a tensile strength of 64 kg/mm$^2$ and a blank thickness of 0.20 mm. The formability and the results of evaluation were as shown in Table 1. The can exhibited poor formability and corrosion resistance, and could not be used as a container.

Comparative Example 3

It was attempted to prepare a thickness-reduced deep-draw-formed can in the same manner as described in Example 1 with the exception of using a steel plate having a carbon content (C) in the steel of 0.10% by weight, a manganese content (Mn) in the steel of 0.50% by weight, a mean diameter of crystal grain of 4.3 μm, a tensile strength of 56 kg/mm$^2$ and a blank thickness of 0.30 mm. As shown in Table 1, however, the can exhibited very poor formability and could not be subjected to the thickness-reducing deep-draw forming.

Comparative Example 4

It was attempted to prepare a thickness-reduced deep-draw-formed can in the same manner as described in Example 1 with the exception of using a steel plate having a carbon content (C) in the steel of 0.01% by weight, a manganese content (Mn) in the steel of 0.20% by weight, a mean diameter of crystal grain of 7.8 μm and a tensile strength of 33 kg/mm$^2$. As shown in Table 1, however, the can exhibited poor formability and could not be subjected to the thickness-reducing deep-draw forming.

Comparative Example 5

It was attempted to prepare a thickness-reduced deep-draw-formed can in the same manner as described in Example 1 with the exception of using a steel plate having a carbon content (C) of 0.11% by weight, a manganese content (Mn) of 0.80% by weight, a mean diameter of crystal grain of 4.4 μm and a tensile strength of 56 kg/mm$^2$, and applying a thermosetting acrylic acid-modified epoxyphenol resin paint onto both surfaces thereof maintaining a thickness of 10 μm as an organic resin coating. As shown in Table 1, however, the can exhibited poor formability and could not be subjected to the thickness-reducing deep-draw forming.

TABLE 1

| Sample No. | C content (%) | Mn content (%) | Mean diameter of crystal grain (μm) | Tensile strength (kg/mm$^2$) | Blank thickness (mm) | Condition of after thickness-reducing deep-draw forming: Steel plate | Condition of after thickness-reducing deep-draw forming: Organic resin | Multi-beading | Tomato soup preservation test (37° C., 6 months), Corrosion on the inner surfaces of can |
|---|---|---|---|---|---|---|---|---|---|
| (Example No.) | | | | | | | | | |
| 1 | 0.10 | 0.50 | 5.4 | 43 | 0.26 | good | good | no | good |

TABLE 1-continued

| Sample No. | C content (%) | Mn content (%) | Mean diameter of crystal grain (μm) | Tensile strength (kg/mm²) | Blank thickness (mm) | Condition of after thickness-reducing deep-draw forming: Steel plate | Condition of after thickness-reducing deep-draw forming: Organic resin | Multi-beading | Tomato soup preservation test (37° C., 6 months), Corrosion on the inner surfaces of can |
|---|---|---|---|---|---|---|---|---|---|
| 2 | 0.10 | 0.50 | 5.4 | 48 | 0.20 | good | good | yes | good |
| 3 | 0.07 | 0.50 | 5.2 | 38 | 0.28 | good | good | no | good |
| 4 | 0.10 | 0.50 | 5.4 | 43 | 0.26 | good | good | no | good |
| (Comparative Example No.) | | | | | | | | | |
| 1 | 0.12 | 0.80 | 4.4 | 58 | 0.26 | good | partly melted at upper portion of can | no | corroded at neck and wrap-seamed portions |
| 2 | 0.16 | 0.80 | 3.8 | 64 | 0.20 | wrinkles developed due to drawing | partly melted at upper portion of can | yes | corroded at neck and wrap-seamed portions |
| 3 | 0.10 | 0.50 | 4.3 | 56 | 0.30 | wrinkles developed due to drawing | peeled off | no | — |
| 4 | 0.01 | 0.20 | 7.8 | 33 | 0.26 | surface coarsened conspicuously | locally peeled off at upper portion of can | no | — |
| 5 | 0.11 | 0.80 | 4.4 | 56 | 0.26 | wrinkles developed due to drawing | coating damaged greatly | no | corroded over the whole surface of the can barrel |

We claim:

1. A thickness-reduced deep-draw-formed can obtained by deep-draw-forming an organic resin-coated structure of a surface-treated steel plate and reducing the thickness of a side wall of the can, said structure comprising, as the substrate, a cold-rolled steel plate having a carbon content in the steel of 0.02 to 0.15% by weight, a manganese content in the steel of 0.2 to 1.0% by weight, a mean diameter of crystal grain of smaller than 6.0 μm, a tensile strength within a range of from 35 to 55 kg/mm², and a thickness of 0.17 to 0.30 mm, and as the organic resin a thermoplastic resin selected from the group consisting of polyester and copolyester, said steel plate and thermoplastic resin being so combined together as to satisfy the following formula, $$S \times t^{1.17} < 0.056 \times (Tm - 45)$$

wherein S is the tensile strength (kg/mm²) of the cold-rolled steel plate, t is the thickness (mm) of the cold-rolled steel plate, and Tm is the melting point (°C.) of the thermoplastic resin, and the degree of reduction of the thickness of the side wall being 5 to 45% of the blank thickness.

2. A thickness-reduced deep-draw-formed can according to claim 1, wherein the organic resin coating layer of the organic resin-coated structure comprises a thermoplastic resin film having a thickness of from 3 to 50 μm.

3. A thickness-reduced deep-draw-formed can according to claim 1, wherein the organic resin coating layer of the organic resin-coated structure comprises the coating of a thermoplastic resin having a coating thickness of from 2 to 30 μm.

4. A thickness-reduced deep-draw-formed can according to claim 1, wherein the surface-treated steel plate comprising, as the substrate, said cold-rolled steel plate, is that which is obtained by treating the surfaces of a cold-rolled steel plate substrate that has a carbon content in the steel of 0.04 to 0.12% by weight, a manganese content in the steel of 0.4 to 0.8% by weight, a mean diameter of crystal grain of 4.0 to 6.0 μm, a tensile strength over a range of from 37 to 48 kg/mm², and a thickness of 0.18 to 0.30 mm.

5. A thickness-reduced deep-draw-formed can according to claim 4, wherein said surface-treated steel plate is an electrolytically chromate-treated steel plate.

6. A thickness-reduced deep-draw-formed can according to claim 4, wherein said surface-treated steel plate is a hard tin plate.

7. A thickness-reduced deep-draw-formed can obtained by deep-draw-forming an organic resin-coated structure of a surface-treated steel plate and reducing the thickness of a side wall of the can, said structure comprising, as the substrate, a cold-rolled steel plate having a carbon content in the steel of 0.02 to 0.15% by weight, a manganese content in the steel of 0.2 to 1.0% by weight, a mean diameter of crystal grain of smaller than 6.0 μm, a tensile strength within a range of from 35 to 55 kg/mm², and a thickness of 0.17 to 0.30 mm, and as the organic resin, a thermoplastic resin, the cold-rolled steel plate and the thermosetting resin being so combined together as to satisfy the following formula, $$S \times t^{1.17} < 0.056 \times (Tg - 75)$$

wherein S is the tensile strength (kg/mm²) of the cold-rolled steel plate, t is the thickness (mm) of the cold-rolled steel plate, and Tg is the glass transition point (°C.) of the thermoplastic resin, and the degree of reduction of the thickness of the side wall being 5 to 45% of the blank thickness.

8. A thickness-reduced deep-draw-formed can according to claim 7, wherein the thermosetting resin is selected from the group consisting of an epoxy-phenolic resin and epoxy-amino resin.

9. A thickness-reduced deep-draw-formed can according to claim 7, wherein the organic resin coating layer of the organic resin-coated structure comprises a thermosetting resin having a film thickness of from 2 to 30 μm.

10. A thickness-reduced deep-draw-formed can according to claim 7, wherein the surface-treated steel plate comprising, as the substrate, said cold-rolled steel plate, is that which is obtained by treating the surfaces of a cold-rolled steel plate substrate that has a carbon content in the steel of 0.04 to 0.12% by weight, a manganese content in the steel of 0.4 to 0.8% by weight, a mean diameter of crystal grain of 4.0 to 6.0 μm, a tensile strength within a range of from 37 to 48 kg/mm$^2$, and a thickness of 0.18 to 0.30 mm.

11. A thickness-reduced deep-draw-formed can according to claim 7, wherein said surface-treated steel plate is an electrolytically chromate-treated steel plate.

12. A thickness-reduced deep-draw-formed can according to claim 7, wherein said surface-treated steel plate is a hard tin plate.

* * * * *